US006189869B1

(12) United States Patent
Stanek et al.

(10) Patent No.: US 6,189,869 B1
(45) Date of Patent: Feb. 20, 2001

(54) WICK SYSTEM FOR A HUMIDIFIER

(75) Inventors: Terrence L. Stanek, St. Charles; Mark J. Tomasiak, O'Fallon; Charles F. Wiegand, St. Charles, all of MO (US)

(73) Assignee: Emerson Electric Co., St. Louis, MO (US)

( * ) Notice: Under 35 U.S.C. 154(b), the term of this patent shall be extended for 0 days.

(21) Appl. No.: 09/264,850

(22) Filed: Mar. 8, 1999

Related U.S. Application Data

(63) Continuation-in-part of application No. 09/122,905, filed on Jul. 27, 1998, now Pat. No. 5,975,502.

(51) Int. Cl.[7] ..... B01F 3/04

(52) U.S. Cl. ..... 261/23.1; 261/36.1; 261/99; 261/107; 261/DIG. 41; 261/DIG. 44

(58) Field of Search ..... 261/23.1, 36.1, 261/99, 104, 106, 107, DIG. 15, DIG. 41, DIG. 44

(56) References Cited

U.S. PATENT DOCUMENTS

| | | | | |
|---|---|---|---|---|
| 794,938 | * | 7/1905 | Houlon | 261/107 |
| 2,002,273 | * | 5/1935 | Parker et al. | 261/104 |
| 2,809,820 | * | 10/1957 | Stoops | 261/106 |
| 2,835,185 | * | 5/1958 | Leatherman | 261/99 |
| 3,136,829 | * | 6/1964 | Skerritt | 261/DIG. 15 |
| 3,791,102 | * | 2/1974 | Huntington | 261/36.1 |
| 4,045,523 | * | 8/1977 | Goettl | 261/106 |
| 4,156,705 | * | 5/1979 | Ogawa et al. | 261/106 |
| 4,460,520 | * | 7/1984 | Wrightson | 261/106 |
| 5,162,088 | * | 11/1992 | Peng et al. | 261/107 |
| 5,289,696 | * | 3/1994 | Kiser et al. | 261/DIG. 15 |
| 5,975,502 | * | 11/1999 | Stanek et al. | 261/36.1 |

* cited by examiner

*Primary Examiner*—C. Scott Bushey
(74) *Attorney, Agent, or Firm*—Howrey Simon Arnold & White, LLP

(57) ABSTRACT

A humidifier with a plurality of wettable wicks is disclosed. According to one aspect of the present invention, the humidifier includes a first wettable wick adapted to humidify an air stream and a first tray for holding water. The first tray is located in a position adapted to wet the first wick by capillary action. The humidifier includes a second wettable wick adapted to humidify the air stream and a second tray for holding water. The second tray is located in a position adapted to wet the second wick by capillary action and adapted to receive water from the first tray. A channel connects the two trays and transfers water from the first tray to the second tray when the water level in the first tray reaches a predetermined level. The use of the channel instead of a tube reduces water noise and the chances for vapor lock.

14 Claims, 5 Drawing Sheets

WICK SYSTEM FOR A HUMIDIFIER

RELATED APPLICATION

This is a continuation-in-part of the application Ser. No. 09/122,905, filed on Jul. 27, 1998, now U.S. Pat. No. 5,975,502.

BACKGROUND OF THE INVENTION

1. Field of the Invention

The present invention relates generally to humidifiers, and more specifically to a wick system for a humidifier and a method operating the wick system.

2. Description of the Related Art

FIG. 1 illustrates the operating principle of a wick system of a prior art humidifier 10. A stream of dry air 12 enters an intake 14 of the humidifier 10. The stream of dry air 12 passes through or over a wet wick 16 and picks up additional moisture to form a humid stream of air 18. The humid stream of air 18 leaves the humidifier by an output 19. One end of the wick 16 makes contact with water in a reservoir 20. Water from the reservoir 20 replenishes water carried away from the wick 16 by the stream of air 18.

Referring to FIG. 1, the wick 16 is wetted by a natural wicking action, i.e., capillary action. The wick 16 may be constructed from a variety of wettable materials, e.g., paper, provided that a substantial area of wick 16 becomes wetted through capillary action when a portion is placed in contact with water. Then, the capillary action draws water into the wick 16 to replenish moisture continually carried away by the stream of air 18.

FIG. 2 illustrates a prior art wick system 22 that uses a continuous water flow 24 to keep the wick 26 wet and capable of humidifying a stream of dry air 28. A pump 30 continually refills a tray 32 with water. Gravity produces the water flow 24 from the holes 23 in the bottom of the tray 32. The water flow 24 moves from the top to the bottom of the wick 26. Excess water drips off the wick 26 into a reservoir 34 positioned below the wick 26. The pump 30 draws water from the reservoir 34 to refill the tray 32. The wick system 22 uses a cyclic flow to keep the wick 26 wetted.

Referring to FIG. 2, the use of the continuous water flow 24 prevents problems associated to water stagnation in the reservoir 20 of FIG. 1. The height of the wick 26, which is wetted by a continuous flow, can also be higher than height of the wick 16 of FIG. 1, which is wetted by capillary action.

Referring to FIG. 2, the use of a continuous flow to keep the wick 26 wetted introduces other problems. The water flow 24 continually carries minerals contained in the wick 26 into the reservoir 34, the pump 30, and the tray 32. These deposits accumulate and lead to a need for periodic cleaning. Additionally, the water flow 24 through the holes 23 causes occasionally water splashing. The water splashing can create an annoying noise that is undesirable in a domestic humidifier. The splashing also deposits minerals, contained in the water, on extraneous parts. The splashing noises and accumulation of minerals, leached out of the wick 26, make the wick system 22 less desirable.

The present invention is directed to overcoming, or at least reducing the effects of, one or more of the problems set forth above.

SUMMARY OF THE INVENTION

In one aspect of the present invention, a humidifier is provided. The humidifier includes a first wettable wick adapted to humidify an air stream and a first tray for holding water. The first tray is located in a position adapted to wet the first wick by capillary action. The humidifier includes a second wettable wick adapted to humidify the air stream and a second tray for holding water. The second tray is located in a position adapted to wet the second wick by capillary action and adapted to receive water from the first tray.

In a second aspect of the present invention, a method for humidifying air is provided. The steps of the method include pumping water from a reservoir to a highest water tray, sending water from the highest water tray to a lower water tray, and wetting a first wick through capillary action. The first wick has a portion in contact with water in the highest water tray. The steps of the method include wetting a second wick through capillary action. The second wick has a portion in contact with water in the lower water tray.

BRIEF DESCRIPTION OF THE DRAWINGS

Other objects and advantages of the invention will become apparent upon reading the following detailed description and upon reference to the drawings in which.

Figure 1:
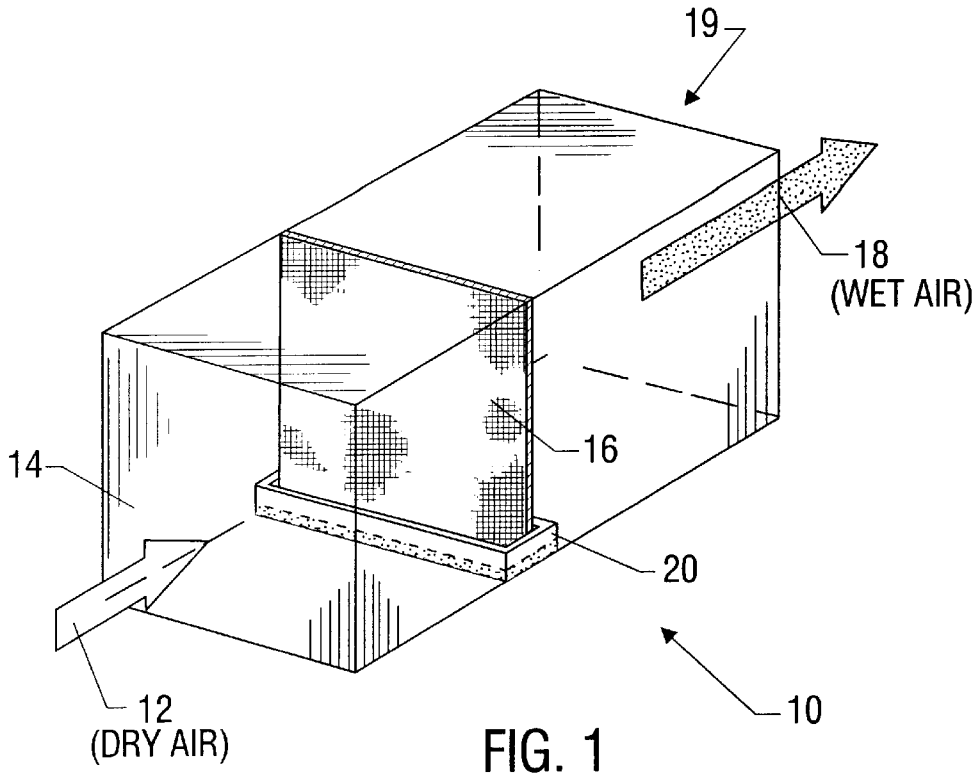
FIG. 1 (PRIOR ART)
FIG. 1 illustrates a prior art humidifier that employs capillary action to wet the wick.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF SPECIFIC EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 3A:
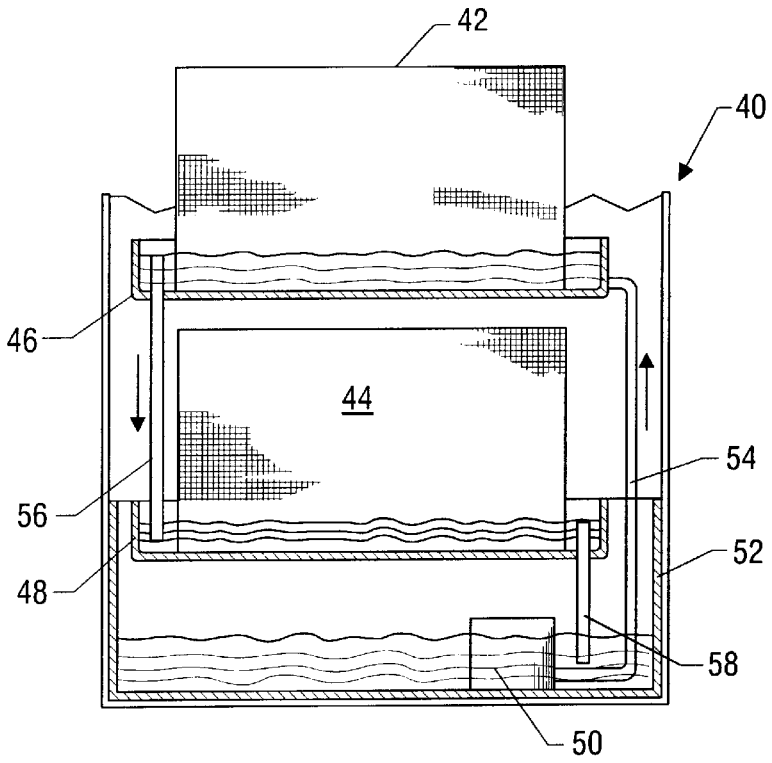
FIG. 3A illustrates a first embodiment of a wick system.

FIG. 3A illustrates a wick system 40 for a humidifier in accordance with one embodiment of the present invention. The wick system 40 includes first and second wicks 42, 44 that are in wettable contact with water held by first and second water trays 46, 48. A pump 50 forces water from a reservoir 52 through a tube 54 to the first water tray 46. A first overflow tube 56 transfers water from the first water tray 46 to the second water tray 48 in response to the water level in the first water tray 46 exceeding a first preselected level. In the illustrated embodiment, the height of the upper end of the overflow tube 56 fixes the first preselected level. A second overflow tube 58 transfers water from the second water tray 48 to the reservoir 52 in response to the water level in the second water tray 48 exceeding a second preselected level. The trays 46, 48 are vertically positioned so that gravity powers the water flows in the overflow tubes 56, 58. The wick system 40 circulates water to the first and second water trays 46, 48 where the natural wetting action, i.e. capillary action, wets the wicks 42, 44.

Figure 3B:
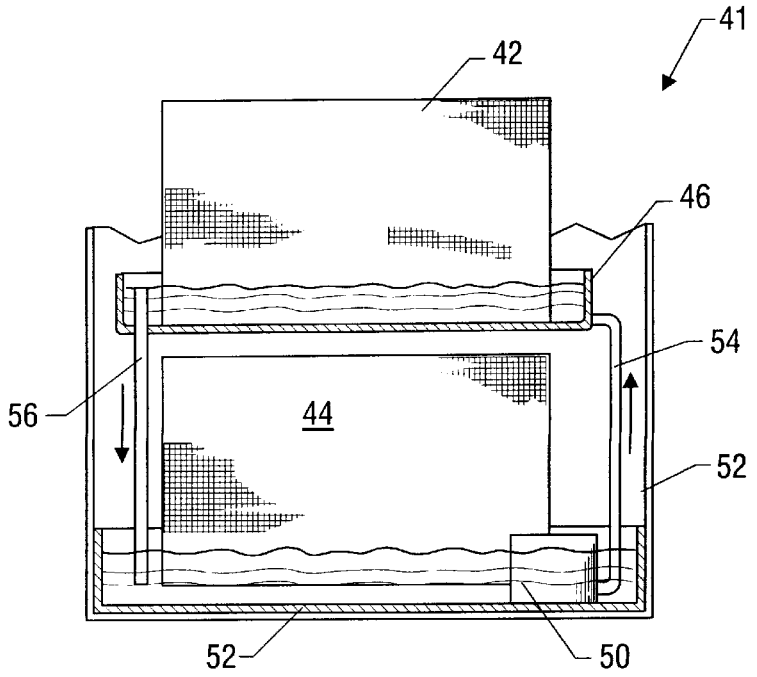
FIG. 3B illustrates a second embodiment of a wick system.
Figure 4:
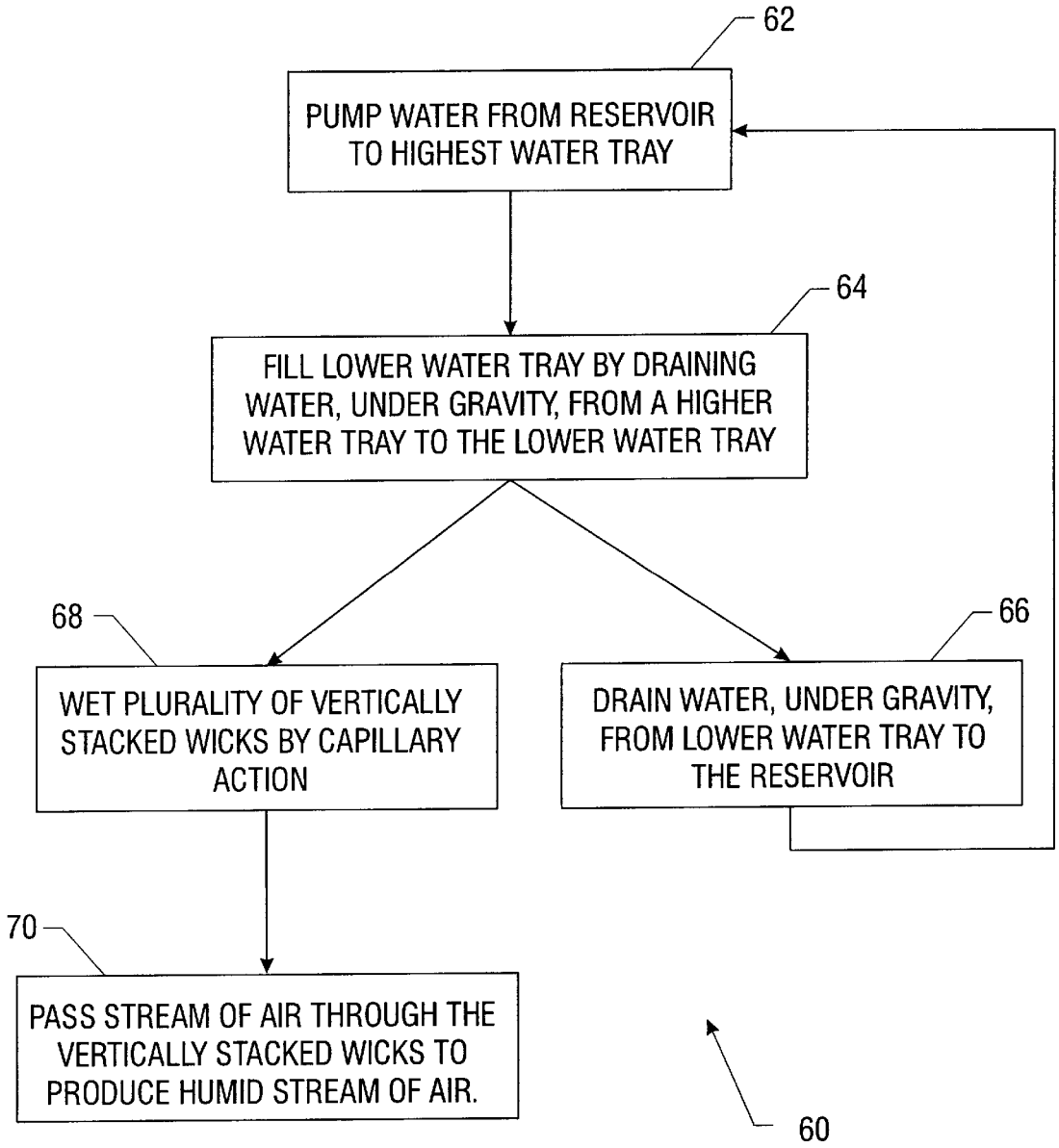
FIG. 4 is a flowchart illustrating a method for using the embodiment of FIG. 3A.

FIG. 3B illustrates a second embodiment of a wick system 41 for a humidifier in accordance with one embodiment of the present invention. The wick system 41 includes the first wick 42 in wettable contact with water held by the water tray 46 and the second wick 44 directly in wettable with the water in the reservoir 52. The pump 50 forces water from the reservoir 52 through a tube 54 to the water tray 46. The overflow tube 56 transfers water from the water tray 46 back to the reservoir 52 in response to the water level in the water tray 46 exceeding a preselected level. The height of the upper end of the overflow tube 56 fixes the preselected level. The trays 46 is vertically positioned so that gravity powers the water flow in the overflow tube 56. The wick system 40 circulates water to the water tray 46 and the natural wetting action, i.e. capillary action, wets the wicks 42, 44 in the water tray 46 and in the reservoir 52.

Figure 5:
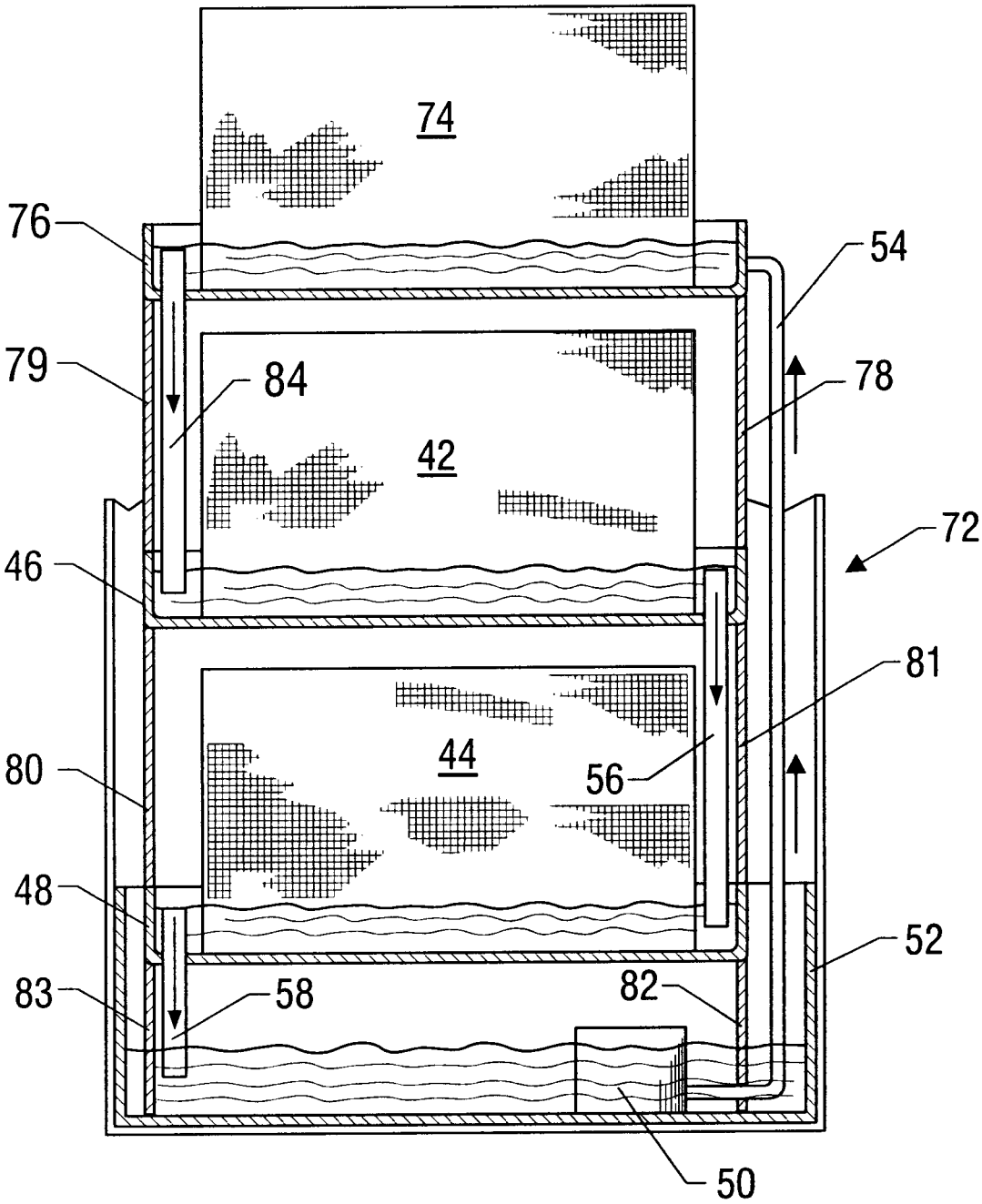
FIG. 5 illustrates a third embodiment of a wick system.

FIG. 5 is a flowchart 60 illustrating the steps of a method for operating the wick system 40 of FIG. 3A. At block 62, water is pumped from the reservoir 52 to the highest water tray 46. At block 64, water fills the lower water tray 48 by draining from the higher water tray 46 under gravity. In one embodiment, the overflow tube 56 is positioned so that water drains to the lower water tray 48 in response to the water level in the higher water tray 46 reaching a preselected level. At block 66, water drains from the lowest water tray 48 back to the reservoir 52. In one embodiment, the overflow tube 58 is positioned so that water drains to the reservoir 52 in response to the water level in the lower water tray 48 reaching a preselected level. At block 68, water continually rises up from the water trays 46, 48 into the wicks 42, 44 through capillary action thereby keeping the wicks 42, 44 moist. In one embodiment, the water rises between about four and seven inches up into the wicks due to capillary action. At block 70, one or more streams of air pass over or through the vertical wet wicks 42, 44 to produce a humid output stream of air.

FIG. 5 illustrates a third embodiment for wick system 72 of a humidifier. The wick system 72 includes several vertically stacked wettable wicks 74, 42, 44. The pump 50 delivers water from the reservoir 52 to the water tray 76 that wets the highest vertically positioned wick 74. The water trays 76, 46, 48 form a stack-like structure in which each layer of the stack, i.e. one of the water trays 76, 46, 48 and the corresponding wick 74, 42,44, is supported on the next lower layer by a plurality of legs 78–83. In one embodiment, the tube 54 is extendible and the water trays 76, 46, 48 and corresponding legs 78–83 are modular so that number of stacked layers may be varied. Each of the overflow tubes 84, 56, 58 transfers water, through gravity, from one of the water trays 76, 46, 48 to the next lower water tray 76, 46, 48 or to the reservoir 52. The pump 50 forces water from the reservoir 52 through the tube 54 to the highest water tray 76, and excess water is displaced by gravity to the lower water trays 46, 48 and to the reservoir 52.

Figure 2:
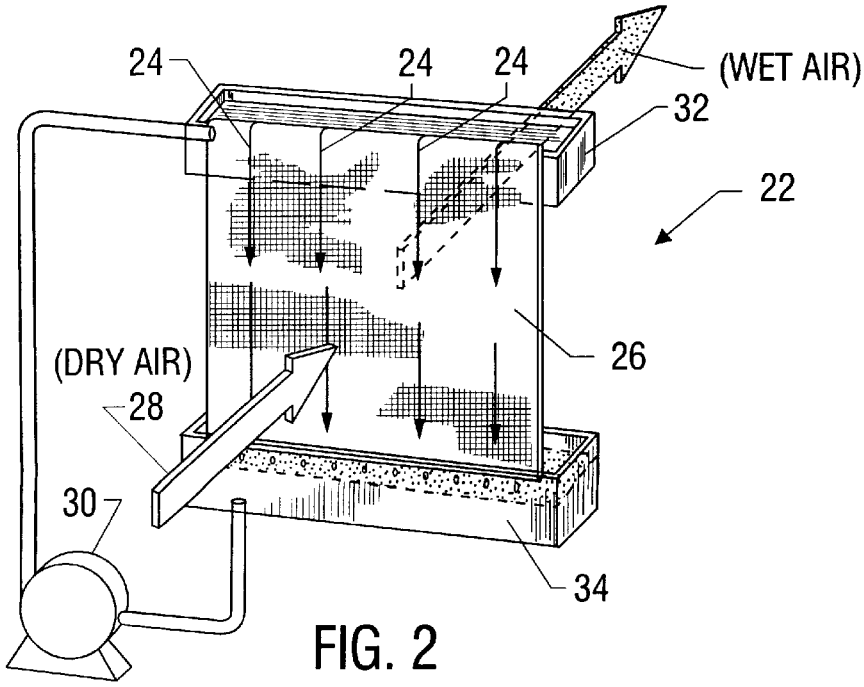
FIG. 2 (PRIOR ART)
FIG. 2 illustrates a wick system of the prior art that utilizes a continuous water flow.

Referring to FIGS. 3A, 3B and 5, the wick systems 40, 41, 72 employ capillary action to wet a substantial portion of the surfaces of the wicks 74, 42, 44 and replenish water removed by evaporation. By employing capillary action, the wick systems 40, 41, 72 of FIGS. 3A, 3B and 5 can keep the wicks 74, 42, 44 moist without the splashing and the significant leeching of minerals from that occurred in the prior art wick system 22 of FIG. 2. Since capillary action leaches less material out of the wicks 74, 42, 44 than a water flow would, some embodiments do not use filters to remove accumulated impurities and/or minerals from the recirculating water. Finally, the water flow speed between the water trays 76, 46, 48 and the reservoir 52 of FIGS. 3A, 3B, and 5 can be adjusted to reduce problems associated with stagnant water.

The wicks 74, 42, 44 of FIGS. 3A, 3B, and 5 can be constructed from a variety of materials, e.g., paper or other material for which a sufficient surface area can be wetted by capillary action. Due to capillary action, substantial portions of the surfaces of each of the wicks 74, 42, 44 become moist in response to dipping an edge of the wick into water. In some embodiments, the wicks 74, 42, 44 allow air currents to pass through even when wet. Known techniques for constructing wicks that allow air currents to pass through include: piercing the wick material with holes, forming the wicks of layered materials with space between layers, and forming wicks of thin materials. If air currents can pass through, the wicks 74, 42, 44 can be stacked to form a thin vertical structure that humidifies the air stream passing therethrough. In some embodiments, the air currents are passed over the surfaces of the wicks 74, 42, 44 as opposed to through the wicks 74, 42, 44 to form humid air. In these embodiments, the wicks 74, 42, 44 and associated water trays 76, 46, 48 may be stacked in an arrangement having more horizontal depth. The invention is intended to cover humidifiers that operate either by passing air currents through or by passing air currents over wet wicks.

Figure 6:
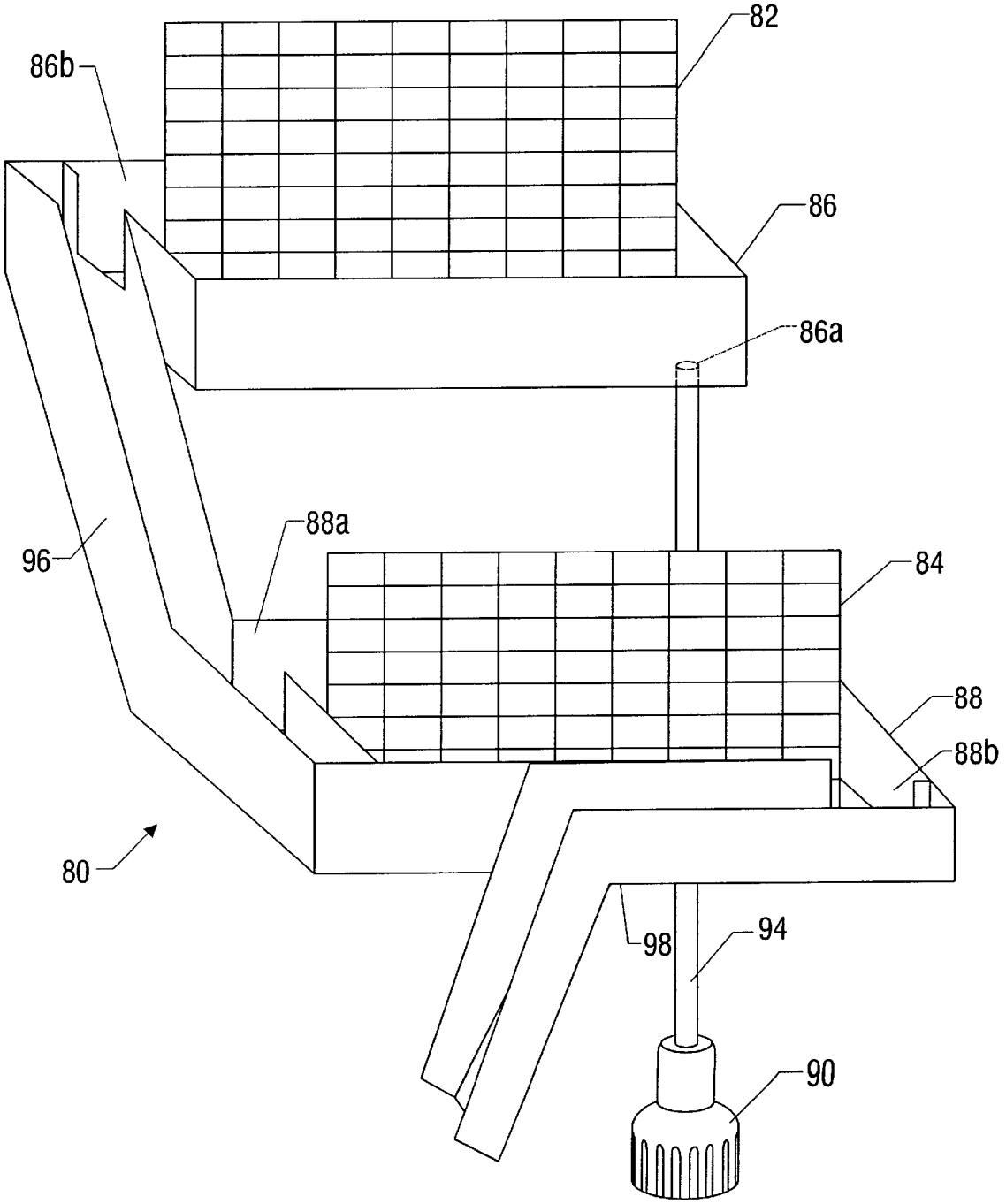
FIG. 6 illustrates a fourth embodiment of a wick system.

In a fourth embodiment of the present invention, as illustrated in FIG. 6, the wick system 80 includes a first wick 82 and a second wick 84 that are disposed partially within the a first rectanglar water tray 86 and second rectanglar water tray 88, respectively, and are thus in wettable contact with water held by the trays 86 and 88. A pump 90 pumps water from a reservoir 92 (not shown) through a tube 94 to the first water tray 86 at the intake port 86*a*. A first sloped channel 96 connects the two water trays 86 and 88 at the exit port 86*b* and intake port 88*a*, respectively, and transfers water from the first water tray 86 to the second water tray 88 when the water level in the first water tray 86 exceeds a first preselected level, fixed by the height of the bottom edge of the exit port 86*b*. A second sloped channel 98 connects the second water tray 88, at the exit port 88*b*, and transfers water from the second water tray to the reservoir 92 when the water level in the second water tray 88 exceeds a second preselected level, fixed by the height of the bottom edge of the exit port 88*b*. The first water tray 86 is positioned above the second water tray 88, which is positioned above the reservoir 92, so that water flows along the first and second channels 96 and 98 under gravity. The intake port 86*a* and exit port 86*b* are spaced apart diagonally across the bottom of the first water tray 86, one on each side of the first wick 82, so as to ensure sufficient contact between the first wick 82 and water and reduce stagnation of water in any part of the water tray 86. Similarly, the intake port 88*a* and exit port 88*b* are spaced apart diagonally across the bottom of the second water tray 88. The use of channels 96 and 98 instead of tubes tends to reduce water noise and the chances for vapor lock.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed is:

1. A humidifier, comprising:

a first wettable wick having two sides and adapted to humidify an air stream;

a first tray for holding water, said first tray being located in a position adapted to wet the first wick by capillary action;

a second wettable wick having two sides and adapted to humidify the air stream;

a second tray for holding water, said second tray being located in a position adapted to wet the second wick by capillary action and positioned below said first tray; and a first sloped channel connecting said first and second trays and adapted to transfer water from said first tray to said second tray.

2. The humidifier as recited in claim 1, further comprising:

a reservoir positioned below said second tray; and a second sloped channel connected to said second tray and adapted to transfer water from said second tray to said reservoir.

3. The humidifier as recited in claim 2, further comprising a pump having an inlet in fluid communication with said reservoir and an outlet in fluid communication with said first tray.

4. The humidifier as recited in claim 1, wherein said first tray defines an intake port to permit water to flow into said first tray and an exit port to permit water to flow out of said first tray and into said first channel; and said first wettable wick is interposed between said intake port and said exit port so that water in said first tray substantially wets said first wick.

5. A humidifier, comprising:

a first tray for holding water;

a first wettable wick adapted to humidify an air stream, said first wettable wick being at least partially disposed within said first tray;

a second tray for holding water and positioned below said first tray;

a second wettable wick adapted to humidify the air stream, said second wettable wick being at least partially disposed within said second tray; and a first sloped channel having a high end and a lower end, said higher end of said first sloped channel defining an intake being in fluid communication with said first tray, and said lower end of said first sloped channel defining an exit being in fluid communication with said second tray, said exit terminating within said second tray, such that said sloped channel defines a fluid flow path between said first and second trays.

6. The humidifier as recited in claim 5, further comprising:

a reservoir positioned below said second tray; and a second sloped channel having a higher end and a lower end, said higher end of said second sloped channel being in fluid communication with said second tray, and said lower end of said second sloped channel being in fluid communication with said reservoir.

7. The humidifier of claim 5, wherein said second wettable wick has a bottom, said bottom of said second wettable wick being at least partially disposed within said second tray; and wherein said lower end of said first sloped channel terminates at a level substantially the same as said bottom of said second wettable wick.

8. The humidifier as recited in claim 4, wherein said exit port of said first tray allows for transfer of water from said first tray to said second tray when said water in said first tray exceeds a first preselected level.

9. The humidifier as recited in claim 2, wherein said second tray defines an intake port to permit water to flow into said second tray and an exit port to pit water to flow out of said second tray and into said reservoir; and said second wettable wick is interposed between said intake port and said exit port so that water in said second tray substantially wets said second wick.

10. The humidifier as recited in claim 9, wherein said exit port of said second tray allows for transfer of water from said second tray to said reservoir when said water in said second tray exceeds a second preselected level.

11. A humidifier, comprising:

a first wick adapted to humidify an air stream;

a tray for holding water, said tray being located in a position adapted to wet the first wick by capillary action;

a second wick adapted to humidify the air;

a reservoir for holding water, said reservoir adapted to wet said second wick by capillary action and positioned below said tray; and a sloped channel connected to said tray and said reservoir and adapted to transfer water from said tray to said reservoir.

12. The humidifier as recited in claim 11, further comprising a pump having an inlet in fluid communication with said reservoir and an outlet in fluid communication with said tray.

13. The humidifier as recited in claim 11, wherein said tray defines an intake port to permit water to flow into said tray from said pump and an exit port to permit water to flow out of said tray and into said sloped channel; and said first wick is interposed between said intake port and said exit port so that water in said tray substantially wets said first wick.

14. The humidifier as recited in claim 13, wherein said exit port of said tray allows for transfer of water from said tray to said reservoir when said water in said tray exceeds a preselected level.

* * * * *

UNITED STATES PATENT AND TRADEMARK OFFICE

CERTIFICATE OF CORRECTION

PATENT NO. : 6,189,869 B1
DATED : February 20, 2001
INVENTOR(S) : Terrence L. Stanek, Mark J. Tomasiak, Charles F. Wiegand It is certified that error appears in the above-identified patent and that said Letters Patent is hereby corrected as shown below:

Column 6,
Line 23, delete "pit" and insert -- permit --

Signed and Sealed this

Twenty fifth Day of September, 2001

*Attest:*

Nicholas P. Godici

NICHOLAS P. GODICI
*Acting Director of the United States Patent and Trademark Office*

*Attesting Officer*